US008370971B2

(12) United States Patent
Wang

(10) Patent No.: US 8,370,971 B2
(45) Date of Patent: Feb. 12, 2013

(54) FAUCET CONNECTING STRUCTURE

(75) Inventor: Ruifu Wang, Guangdong Pr. (CN)

(73) Assignee: Globe Union Industrial Corp., Taichung (TW)

( * ) Notice: Subject to any disclaimer, the term of this patent is extended or adjusted under 35 U.S.C. 154(b) by 319 days.

(21) Appl. No.: 12/961,433

(22) Filed: Dec. 6, 2010

(65) Prior Publication Data

US 2012/0137428 A1 Jun. 7, 2012

(51) Int. Cl.
*E03C 1/042* (2006.01)

(52) U.S. Cl. ..... 4/695; 4/678; 285/340

(58) Field of Classification Search ..... 4/695, 678; 137/801; 285/340
See application file for complete search history.

(56) References Cited

U.S. PATENT DOCUMENTS 6,729,344 B1 * 5/2004 Hung ..... 4/678
6,860,523 B2 * 3/2005 O'Neill et al. ..... 285/340

* cited by examiner

*Primary Examiner* — Tuan N Nguyen

(57) ABSTRACT

A faucet connecting structure contains a body including an internal chamber having a groove; an outlet pipe including an inlet end and an outlet end; the inlet end including an connecting segment with a slot; a retaining loop to define a C-shaped peripheral wall and an elongated opening; the peripheral wall including an outer face having plural first raised portions to form a first flexible deforming structure and having plural first recessed portions, including an inner face having plural second raised portions to form a second flexible deforming structure and having plural second recessed portions, the peripheral wall also including a first end and a second end, and the first end including a rib; a limiting means used to limit the retaining loop in the groove of the body to prevent the outlet pipe from disengagement from the body.

9 Claims, 14 Drawing Sheets

FAUCET CONNECTING STRUCTURE

BACKGROUND OF THE INVENTION

1. Field of the Invention

The present invention relates to a faucet connecting structure to prevent an outlet pipe from vibration when it is connected on a body of a faucet.

2. Description of the Prior Art

An outlet pipe and a body of a conventional facet are fitted with each other and then welded together, however a welding connection will generate weld craters to be ground and polished further, having poor appearance and high production cost.

To solve above-mentioned defects, an improved connecting method is developed to control a working precision of a connection of the outlet pipe and the body of the conventional facet. Nevertheless, such an improved connecting method of the outlet pipe and the body has to be kept at a certain connecting precision so as to connect the outlet pipe and the body well, having high production cost. In addition, if the connecting precision is not precise enough, related parts can not be fitted with each other properly, accordingly the outlet pipe will vibrate during connecting with the faucet to influence connecting quality of the faucet badly.

The present invention has arisen to mitigate and/or obviate the afore-described disadvantages.

SUMMARY OF THE INVENTION

The primary object of the present invention is to provide a faucet connecting structure which is capable of overcoming the shortcomings of the conventional faucet connecting structure.

To obtain the above objectives, a faucet connecting structure provided by the present invention contains:

a body including an internal chamber, and the internal chamber including a groove disposed on a top end thereof, the groove including an orifice formed on a top end thereof;

an outlet pipe including an inlet end and an outlet end; the inlet end including an connecting segment to be inserted into the groove from the orifice of the body, and the connecting segment including a slot secured on an outer surface thereof; wherein the slot is comprised of a peripheral fence, an internal fence, and an external fence;

a retaining loop made of a resilient material and formed in a C-ring shape to define a C-shaped peripheral wall and an elongated opening to be expended and retracted elastically; the peripheral wall including an outer face formed in a wave shape, and the outer face including a plurality of adjacent first raised portions and first recessed portions, and the first raised portions being formed a first flexible deforming structure; the peripheral wall also including an inner face formed in a wave shape, and the inner face including a number of adjacent second raised portions and second recessed portions, the second raised portions being formed a second flexible deforming structure, and the second raised portions being in response to the first recessed portions respectively, the second recessed portions corresponding to the first raised portion individually;

the peripheral wall of the retaining loop including a first end and a second end axially formed thereon, and the first end including a rib radially extending outward therefrom;

the retaining loop being retained in the slot of the connecting segment of the outlet pipe by using the opening, and the rib engaging with the internal fence of the slot, thereafter the retaining loop is further inserted into the groove of the body, such that the retaining loop is pressed by one radial force from the groove and the peripheral fence by ways of the first and the second flexible deforming structures of the outer and the inner faces of the retaining loop to cause one flexible deformation and one radial engaging force against the groove and the slot of the outlet pipe, hence the retaining loop, the body, and the outlet pipe engage with one another tightly, and the outlet pipe is limited securely without vibration with the body when a user touches the outlet pipe;

a limiting means used to limit the retaining loop in the groove of the body to prevent the outlet pipe from disengagement from the body.

Thereby, the retaining loop is pressed by one radial force from the groove and the peripheral fence by ways of the first and the second flexible deforming structures of the outer and the inner faces of the retaining loop to cause one flexible deformation and one radial engaging force against the groove and the slot of the outlet pipe. Therefore, the retaining loop, the body, and the outlet pipe engage with one another tightly, and the outlet pipe is limited securely without vibration with the body when a user touches the outlet pipe.

The flexible deformation generating from the forced retaining loop is served to eliminate a fitting gap between the body and the outlet pipe so as to enhance connecting strength, such that a working precision between related parts is lowered to decrease production cost and increase yield rate of the product.

Likewise, the retaining loop is fixed on the connecting segment of the outlet pipe in advance and then is connected with the body to avoid conventional welding process and grinding process, thereby preventing from weld craters and enhancing aesthetics appearance.

The limiting means is used to limit the retaining loop in the groove of the body to prevent the outlet pipe from axially moving and rotating relative to the body, connecting the faucet securely.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
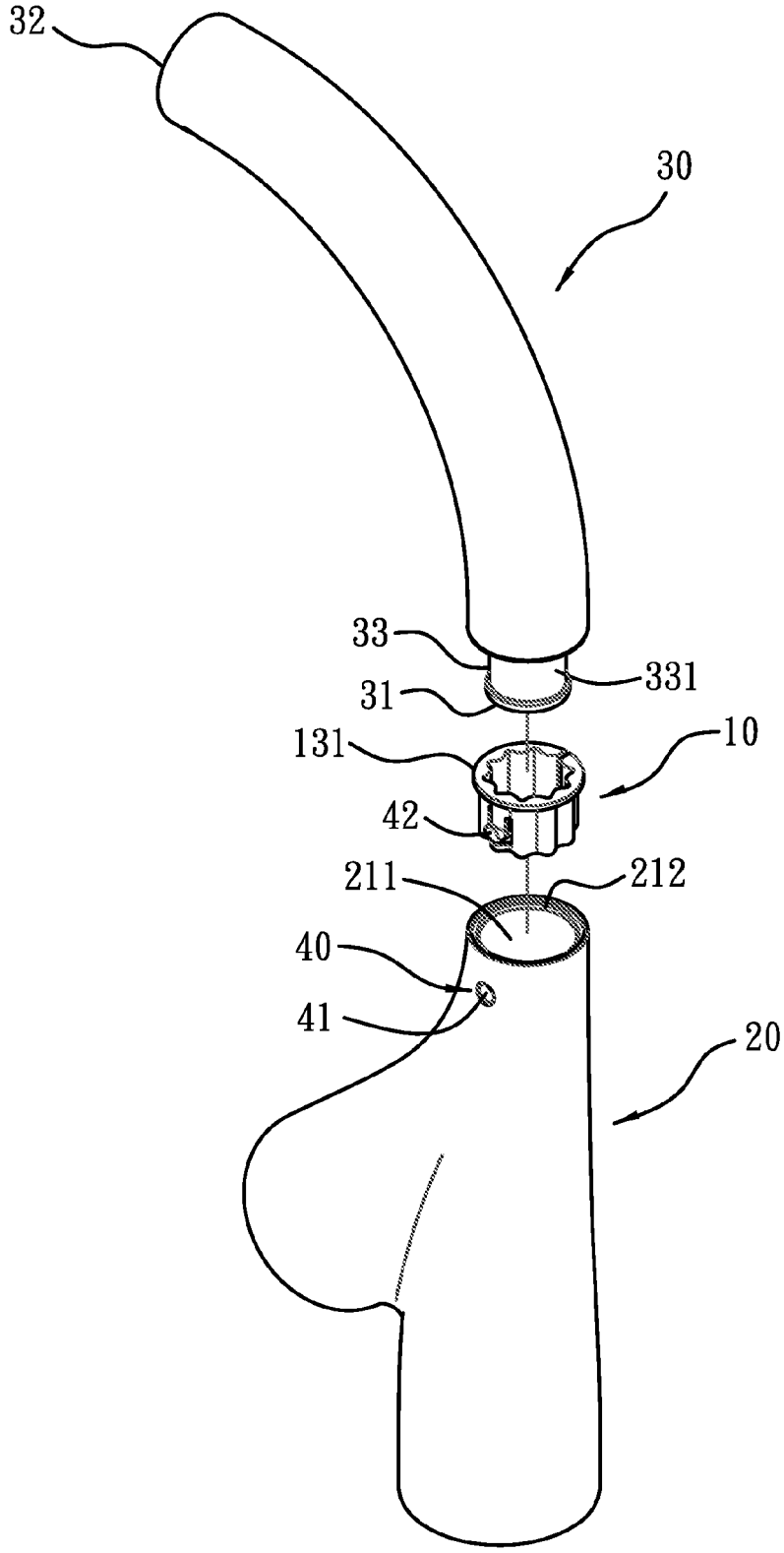
FIG. 1 is a perspective view showing the exploded components of a faucet connecting structure according to a first embodiment of the present invention.

Referring to FIG. 1, a faucet connecting structure according to a first embodiment of the present invention comprises a retaining loop 10, a body 20, an outlet pipe 30, and a limiting means 40.

Figure 2:
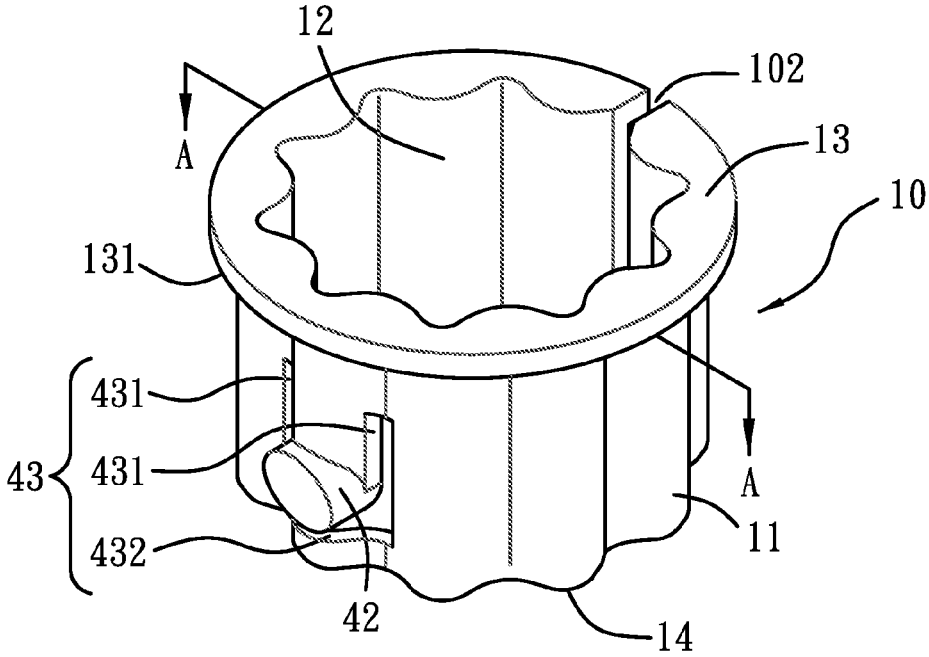
FIG. 2 is a perspective view showing the assembly of a retaining loop of the faucet connecting structure according to the first embodiment of the present invention.
Figure 3:
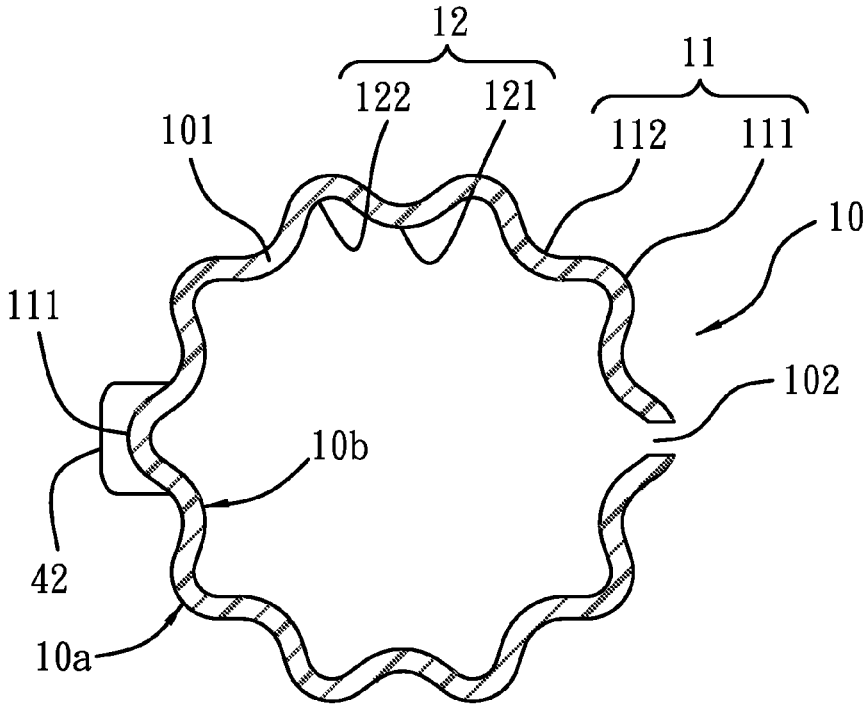
FIG. 3 is a cross sectional view taken along the line A-A of FIG. 2.

The retaining loop 10, as shown in FIGS. 2 and 3, is made of a resilient material, such as a rubber material or a plastic material, and is formed in a C-ring shape to define a C-shaped peripheral wall 101 and an elongated opening 102 to be expended and retracted elastically.

The peripheral wall 101 includes an outer face 11 formed in a wave shape, and the outer face 11 includes a plurality of adjacent first raised portions 111 and first recessed portions 112, and the first raised portions 111 are formed a first flexible deforming structure 10*a*, wherein there are ten first raided portions 111 and ten first recessed portions provided in this embodiment.

The peripheral wall 101 includes an inner face 12 formed in a wave shape, and the inner face 12 includes a number of adjacent second raised portions 121 and second recessed portions 122, and the second raised portions 121 are formed a second flexible deforming structure 10*b*, and the second raised portions 121 are in response to the first recessed portions 112 respectively, the second recessed portions 122 correspond to the first raised portion 111 individually; wherein there are ten second raised portions 121 and ten second recessed portions 122 provided in this embodiment.

The peripheral wall 101 of the retaining loop 10 includes a first end 13 and a second end 14 axially formed thereon, and the first end 13 includes a rib 131 radially extending outward therefrom.

The first raised portions 111, the first recessed portions 112, the second raised portions 121, the second recessed portions 122 of the retaining loop 10 axially extend from the first end 13 to the second end 14.

The opening 102 of the retaining loop 10 is capable of being fixed on a middle section of one of the first raised portions 111, a middle section of one of the first recessed portions 112, or any positions of the first raised or the second recessed portions.

Figure 7:
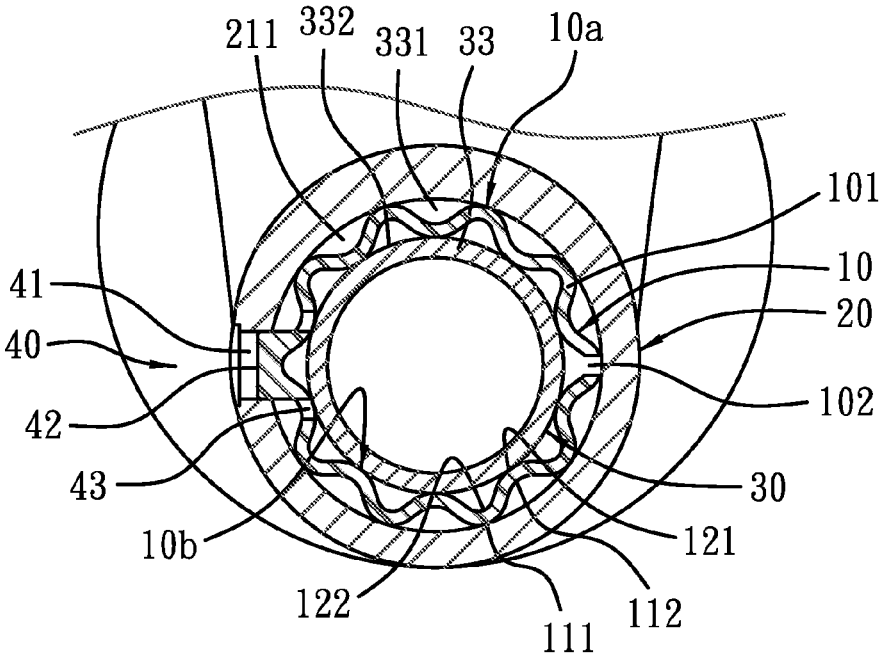
FIG. 7 is also another cross sectional view showing the operation of the faucet connecting structure according to the first embodiment of the present invention.
Figure 8:
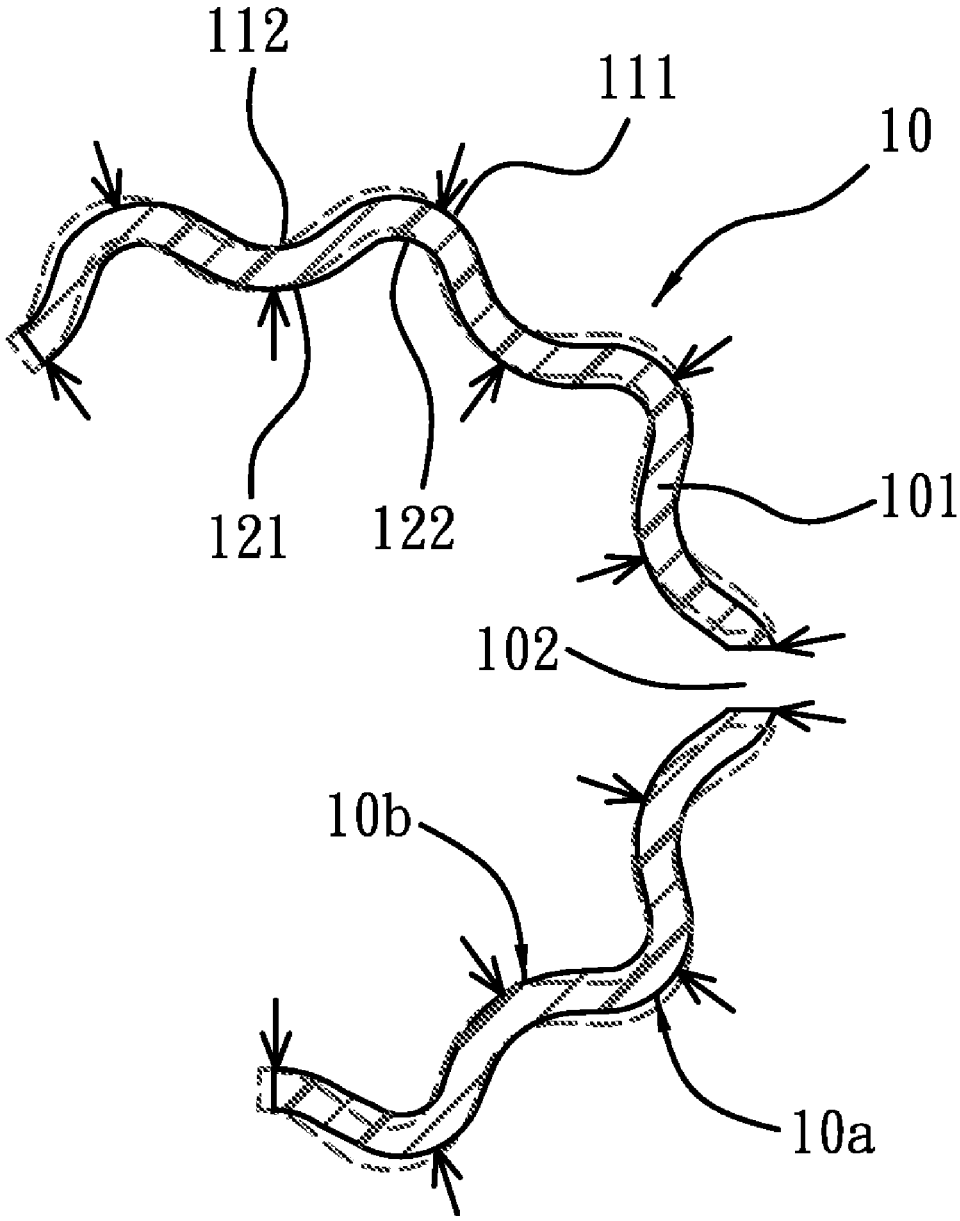
FIG. 8 is a cross sectional view showing the retaining loop of the faucet connecting structure causes a flexible deformation after it is forced according to the first embodiment of the present invention.
Figure 9:
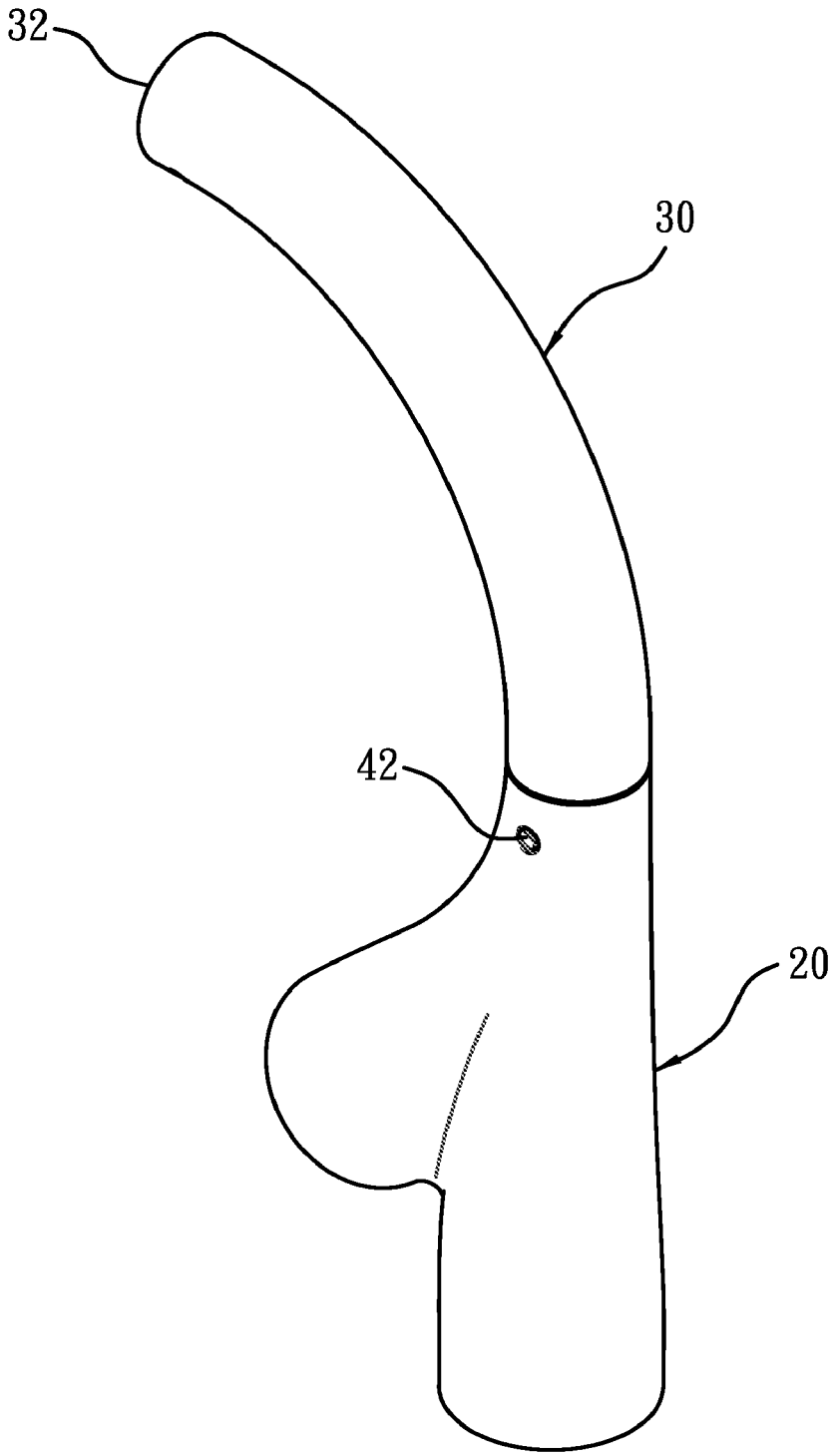
FIG. 9 is a perspective view showing the assembly of the faucet connecting structure according to the first embodiment of the present invention.
Figure 10:
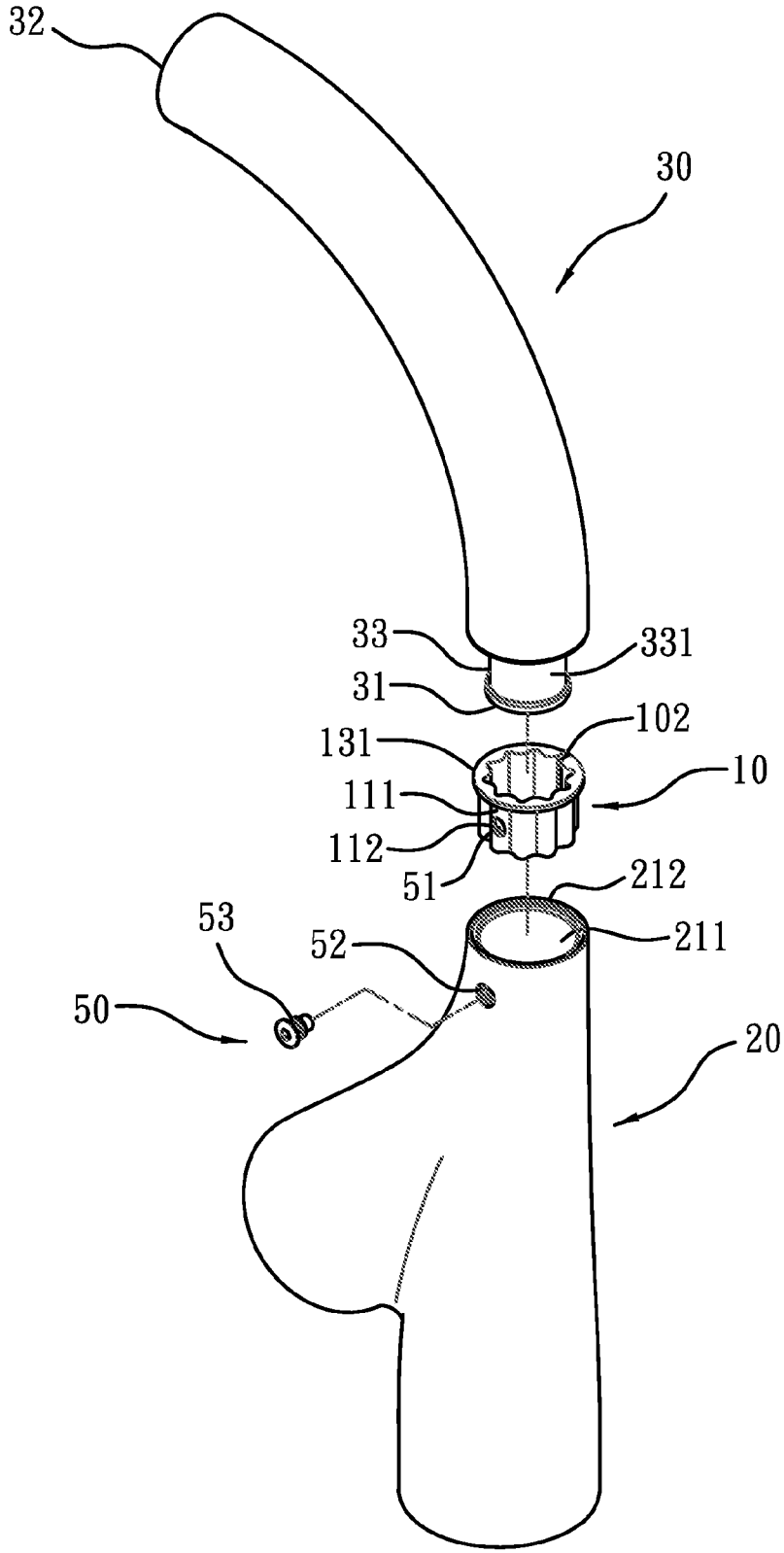
FIG. 10 is a perspective view showing the exploded components of a faucet connecting structure according to a second embodiment of the present invention.
Figure 11:
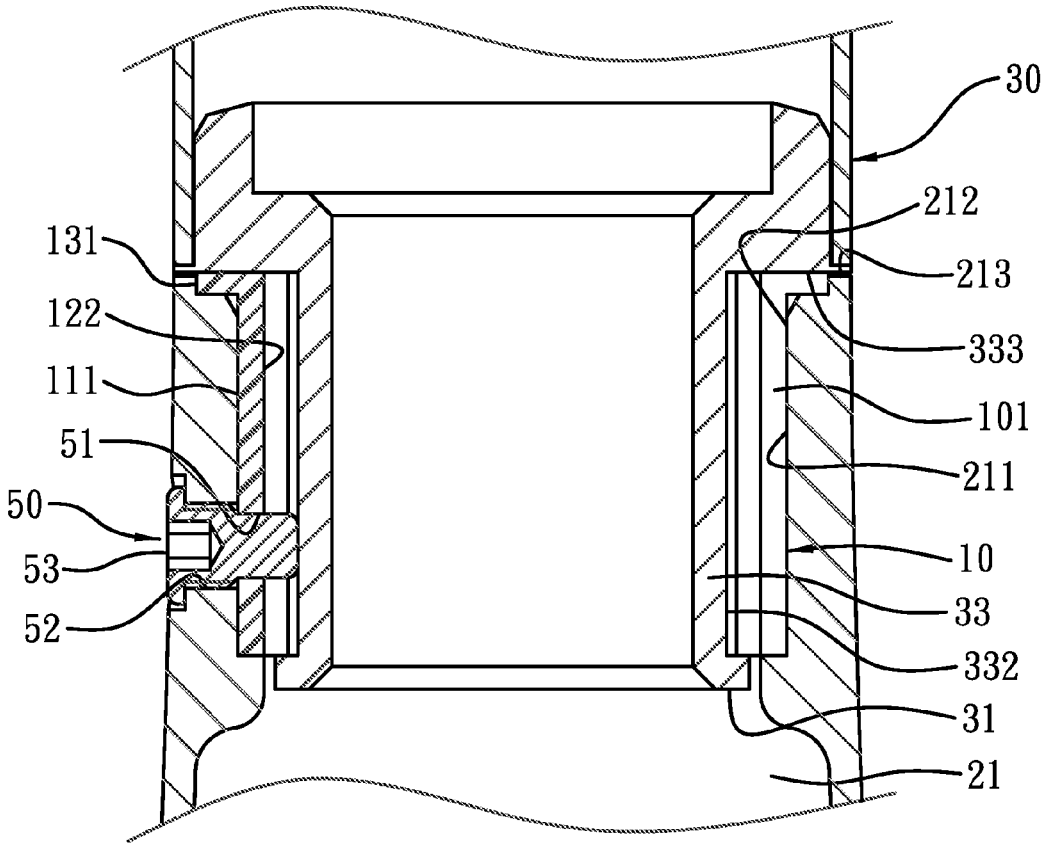
FIG. 11 is a cross sectional view showing the operation of the faucet connecting structure according to the second embodiment of the present invention.
Figure 12:
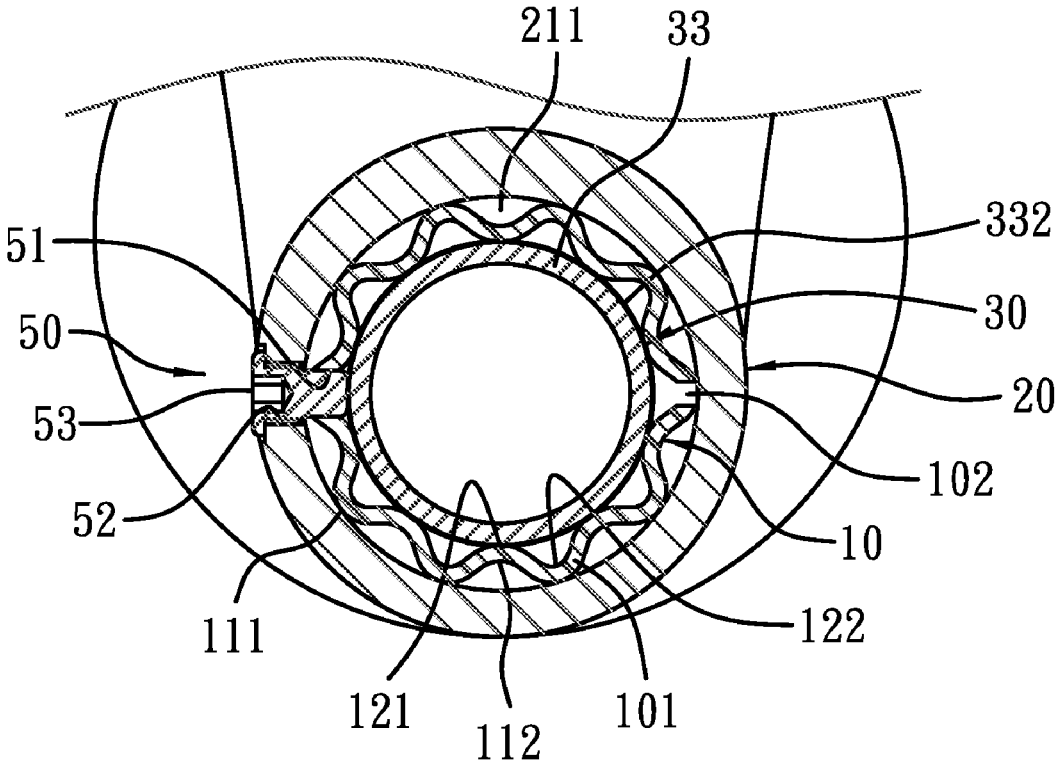
FIG. 12 is another cross sectional view showing the operation of the faucet connecting structure according to the second embodiment of the present invention.
Figure 13:
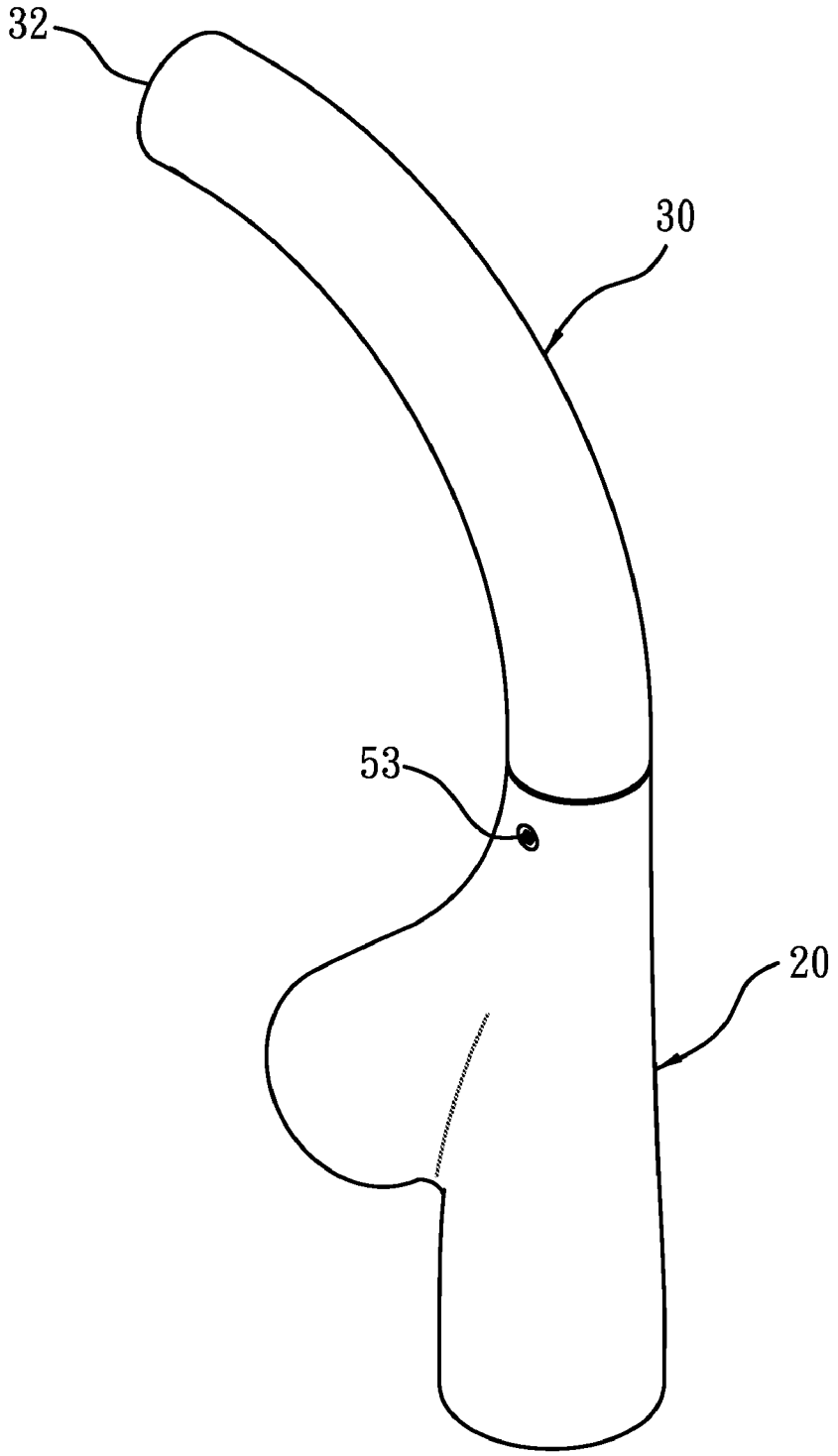
FIG. 13 is a perspective view showing the assembly of the faucet connecting structure according to the second embodiment of the present invention.
Figure 14:
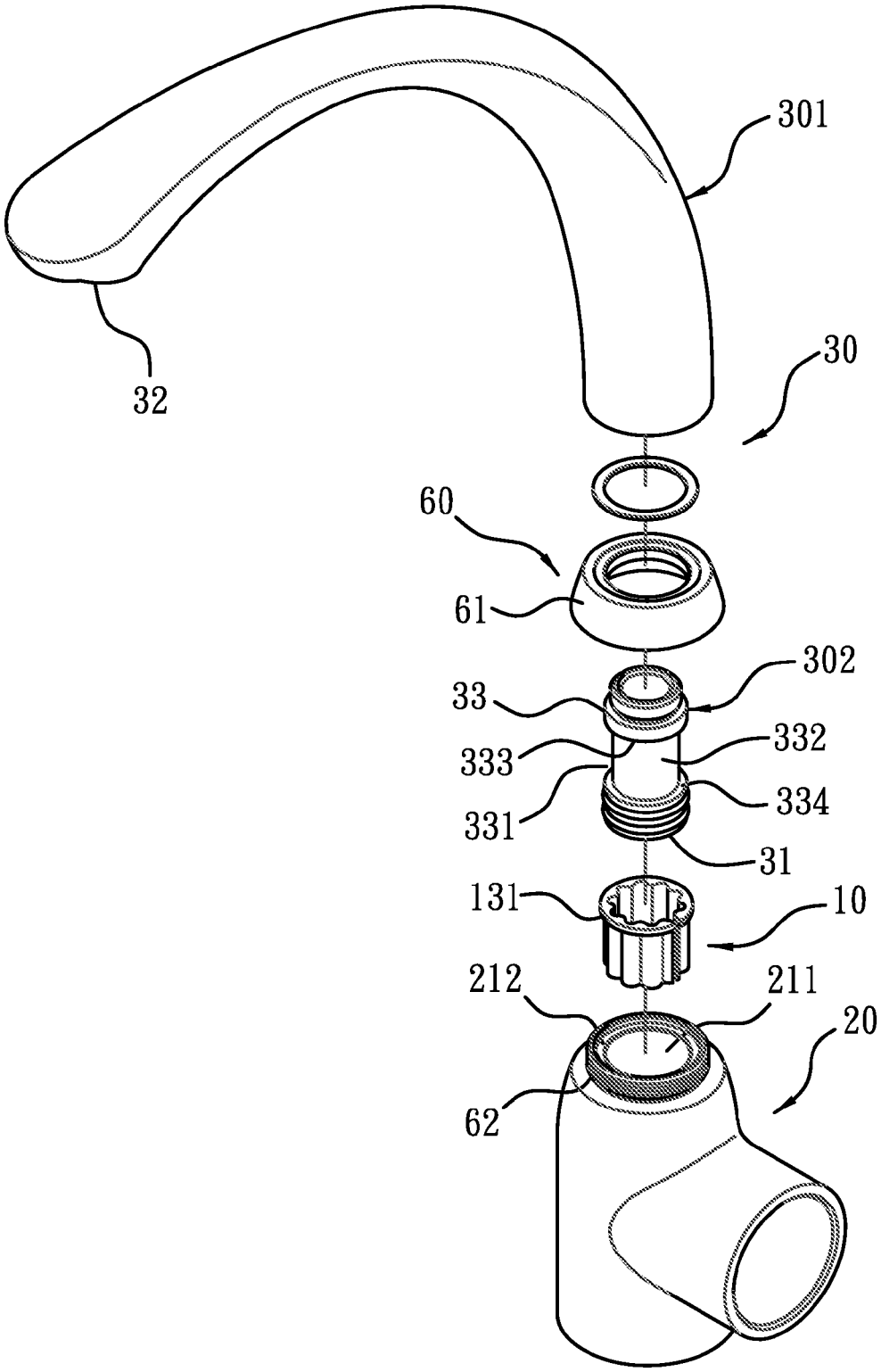
FIG. 14 is a perspective view showing the exploded components of a faucet connecting structure according to a third embodiment of the present invention.
Figure 15:
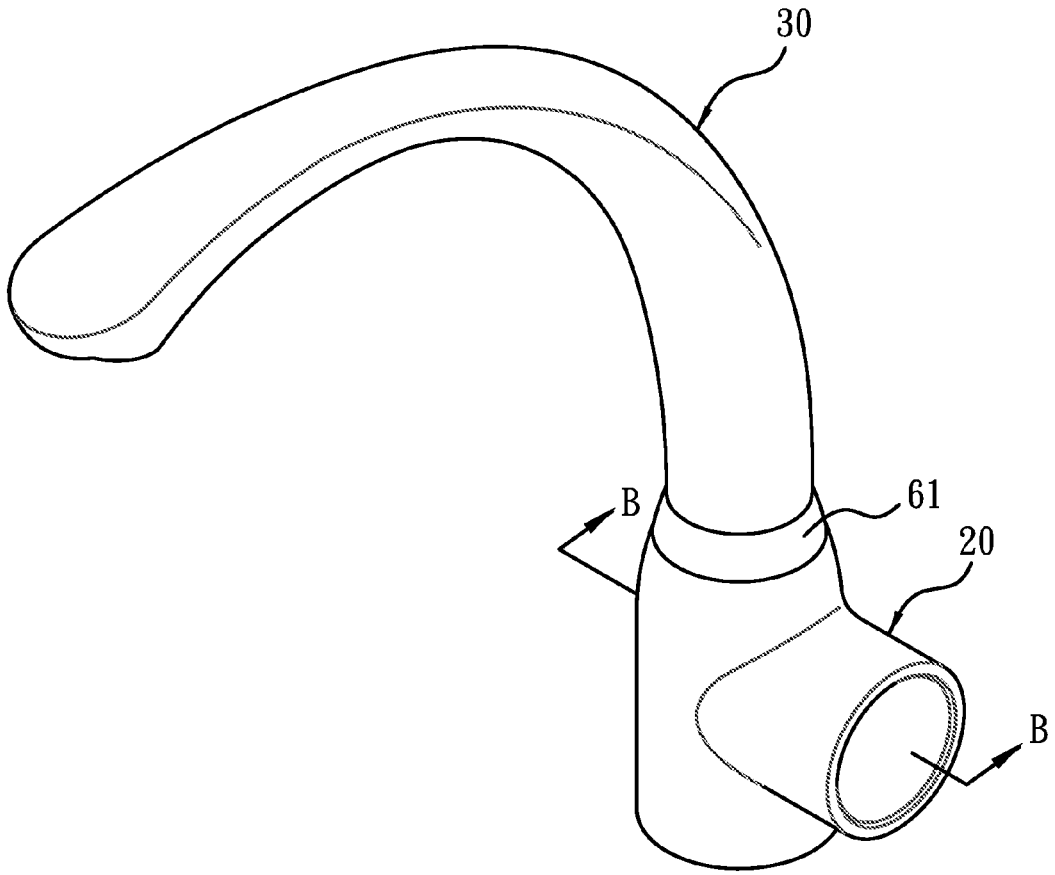
FIG. 15 is a perspective view showing the assembly of the faucet connecting structure according to the third embodiment of the present invention.
Figure 16:
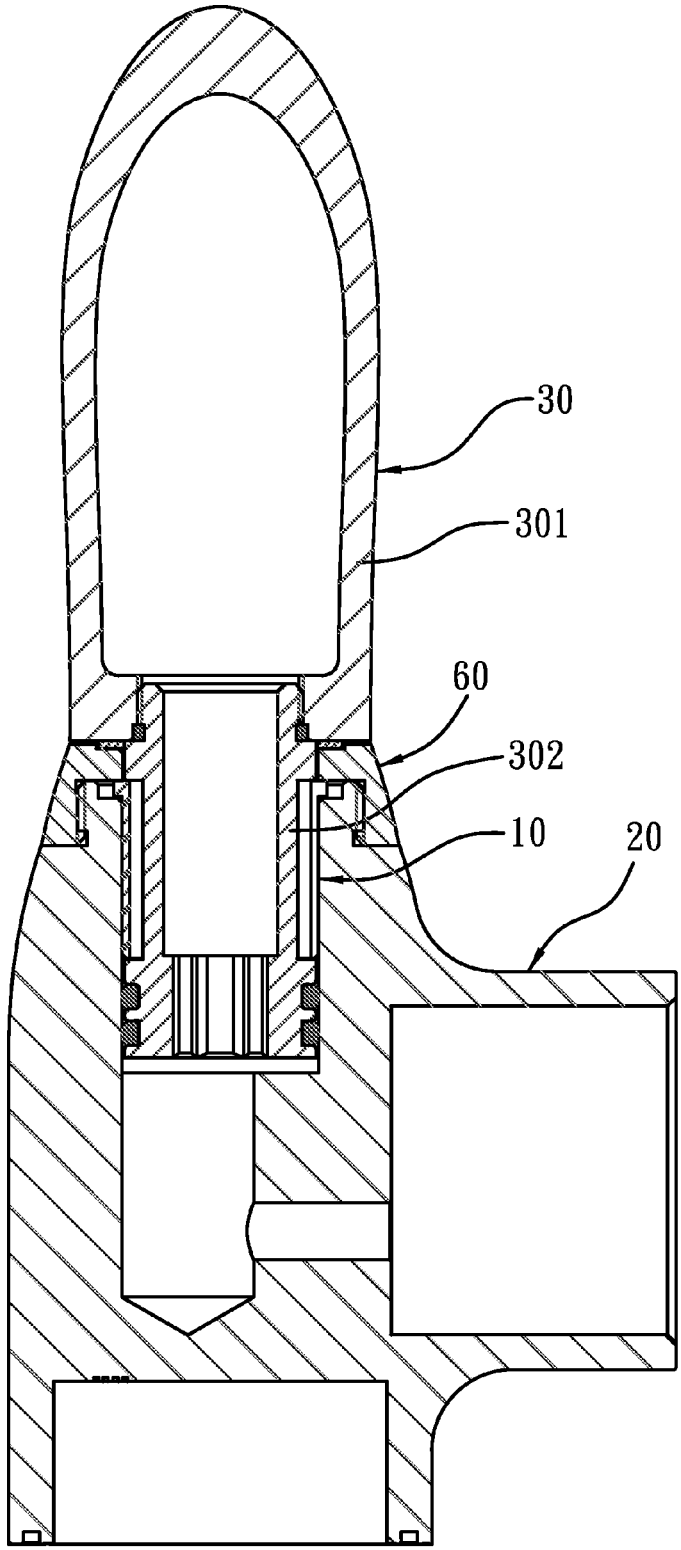
FIG. 16 is a cross sectional view taken along the line B-B of FIG. 15.
Figure 17:
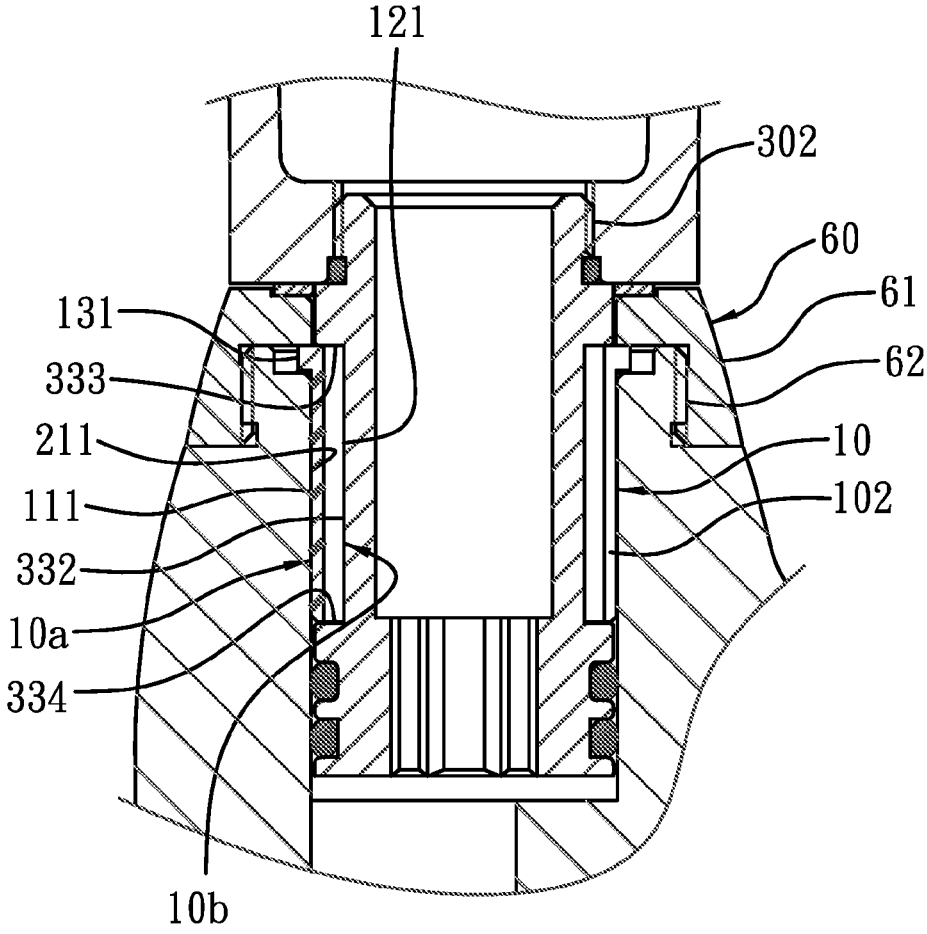
FIG. 17 is an amplified view of FIG. 16.

The first and the second flexible deforming structures 10*a*, 10*b* generate a radially flexible deformation when they are pressed by a radial force as illustrated in FIG. 8, wherein a dotted line represents a unforced profile before the first and the second deforming structures are forced, and a solid line means a forced profile after the first and the second deforming structures are forced. It is to be noted that the first flexible deforming structure 10*a* generates the flexible deformation when it is acted by the radial force, because the first raised portions 111 of the first flexible deforming structure 10*a* correspond to the second recessed portions 122 of the second flexible deforming structure 10*b* respectively to provide a flexible deforming space. As shown in FIGS. 7 and 8, when the first flexible deforming structure 10*a* is acted by an outward radial force, it causes a first flexible deformation and an outward radial engaging force against the first flexible deformation to be applied in further connecting process of the faucet. Also, due to the second raised portions 122 of the second flexible deforming structure 10*b* correspond to the first recessed portions 112 individually so as to provide another flexible deforming space, when the second flexible deforming structure 10*b* is acted by an inward radial force, it generates a second flexible deformation and an inward radial engaging force against the second flexible deformation to be used in further connecting process of the faucet.

Figure 5:
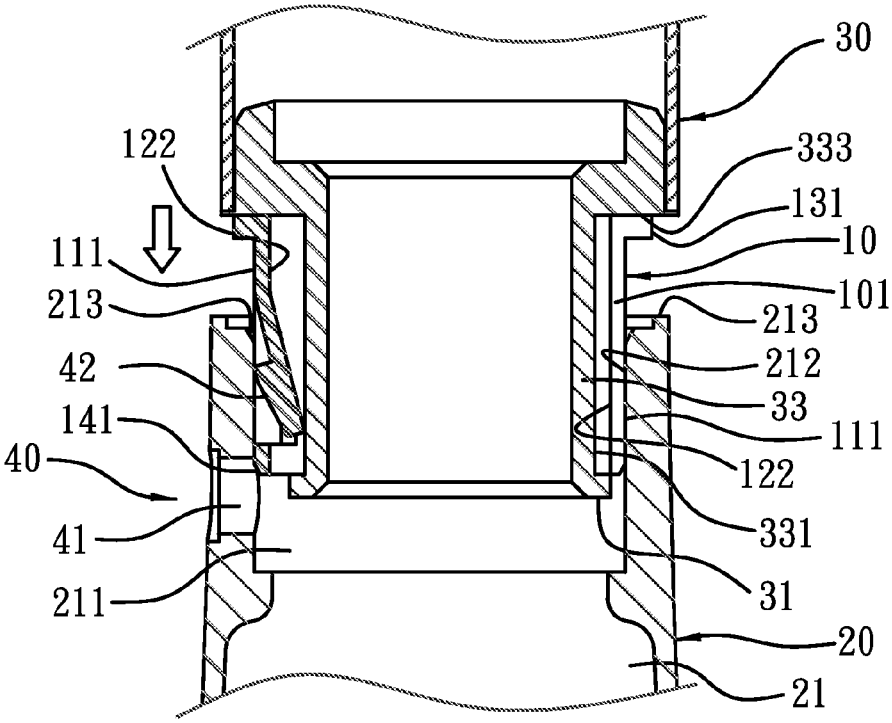
FIG. 5 is a cross sectional view showing the operation of the faucet connecting structure according to the first embodiment of the present invention.

The body 20, as illustrated in FIGS. 1 and 5, includes an internal chamber 21, and the internal chamber 21 includes a groove 211 disposed on a top end thereof, and the groove 211 includes an orifice 212 formed on a top end thereof.

Figure 4:
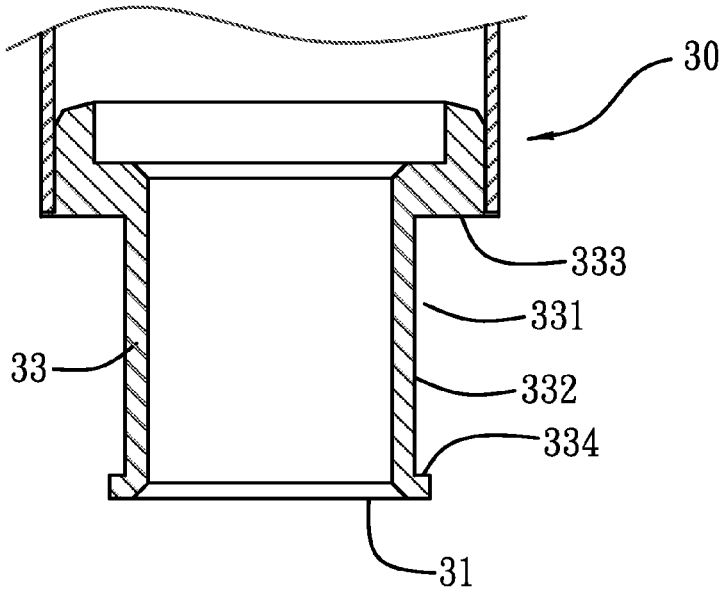
FIG. 4 is a cross sectional view showing an inlet end of an outlet pipe of the faucet connecting structure according to the first embodiment of the present invention.

The outlet pipe 30, as shown in FIGS. 1 and 4, includes an inlet end 21 and an outlet end 32; the inlet end 31 includes an connecting segment 33 to be inserted into the groove 211 from the orifice 212 of the body 20, and the connecting segment 33 includes a slot 331 secured on an outer surface thereof to retain the retaining loop 10; wherein the slot 331 is comprised of a peripheral fence 332, an internal fence 333, and an external fence 334.

Figure 6:
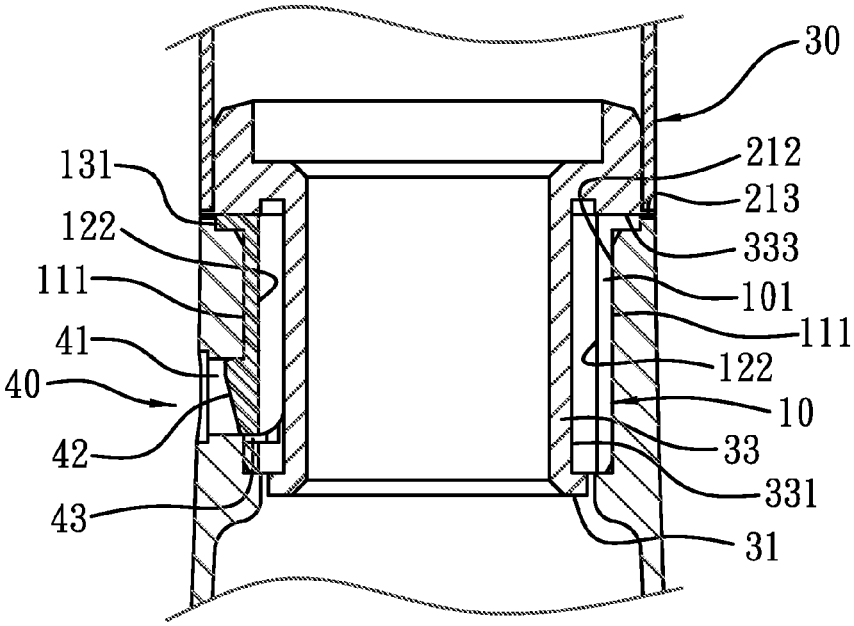
FIG. 6 is another cross sectional view showing the operation of the faucet connecting structure according to the first embodiment of the present invention.

The retaining loop 10 is retained in the slot 331 of the connecting segment 33 of the outlet pipe 30 by using the opening 102, and the rib 131 engages with the internal fence 333 of the slot 331, thereafter the retaining loop 10 is further inserted into the groove 211 of the body 20 as illustrated in FIGS. 5-7, such that the retaining loop 10 is pressed by one radial force from the groove 211 and the peripheral fence 332 by ways of the first and the second flexible deforming structures 10*a*, 10*b* of the outer and the inner faces 11, 12 of the retaining loop 10 to cause one flexible deformation and one radial engaging force against the groove 211 and the slot 331 of the outlet pipe 30. Thereby, the retaining loop 10, the body 20, and the outlet pipe 30 engage with one another tightly, and the outlet pipe 30 is limited securely without vibration with the body 20 when a user touches the outlet pipe 30.

It is to be noted that the rib 131 of the retaining loop 10 is capable of being positioned between the internal fence 333 of the slot 331 and a top end of an inner surface of the body 20 to provide an abutting and engaging effect as a pad.

Besides, a diameter of the first flexible deforming structure 10*a* is slightly more that an inner diameter of the groove 211 when the first flexible deforming structure 10*a* is not forced so that the first and the second flexible deforming structures 10*a*, 10*b* obtain excellent flexible deformation and radial forcing force.

The limiting means 10, as illustrated in FIGS. 1 and 2, includes a locking hole 41 and a movable engagement block 42; the locking hole 41 is disposed at a position of the body 20 relative to the groove 211, wherein the locking hole 41 is directly formed on the body 20 in this embodiment; and the engaging block 42 is fixed on the outer face 11 of the retaining loop 10, wherein the engagement block 42 is directly formed on the outer face 11 of the retaining loop 10 in this embodiment as shown in FIG. 5 so that the engagement block 42 is retained into the locking hole 41 of the body 20, thus axially limiting the retaining loop 10 in the groove 211.

The engagement block 42 integrally extends from the first raised portion 111 of the outer face 11 of the retaining loop 10 close to the second end 14, and the limiting means 40 further includes a U-shaped cutout 43 comprised of two first recesses 431 on two sides of the engagement block 42 respectively and a second recess 432 below a bottom end of the engagement block 42, such that the engagement block 42 of the first raised portion 111 swings inward as the first raised portion 111 is forced as shown in FIG. 5 without preventing the retaining loop 10 from being placed into the groove 211, and the engagement block 42 is aligned with the locking hole 41 to return back to its original position and to be retained in the locking hole 41, thus limiting the outlet pipe 30 to move axially in relation to the body 20.

The engagement block 42 is selectively located at one of the first raised portions 111 so that when it is pressed, the second recessed portion 122 allows to provide a space to make the engagement block 42 swing inward as illustrated in FIG. 4, thus further connecting with the retaining loop 10 well.

To guide the retaining loop 10 into the groove 211 smoothly, on a connection of the second end 14 and the outer face 11 of the retaining loop 10 is formed a tilted or arcuate guiding face 141 as illustrated in FIG. 5, and on the orifice 212 of the groove 211 is arranged an annularly inclined plane 213.

With reference to FIGS. 9-13, a difference of a faucet connecting structure according to a second embodiment of the present invention from that of the first embodiment comprises:

a limiting means 50 including a positioning aperture 51, a screw bore 52, and a fixing bolt 53 with screws; the positioning aperture 51 is fixed on an annularly peripheral wall 101 of a retaining loop 10; the screw bore 52 is disposed on a groove 211 of a body 20; thereby after the retaining loop 10 is inserted into the groove 211 of the body 20 with a connecting segment 33 of an outlet pipe 30, the fixing bolt 53 is screwed with the screw bore 52 of the body 20 so that a distal end of the fixing bolt 52 is inserted into the positioning aperture 51 to retain the retaining loop 10 with the body 20 and to limit the outlet pipe 30 to move axially and rotate in relation to the body 20.

Referring to FIGS. 14-17, a difference of a faucet connecting structure according to a third embodiment of the present invention from that of the first embodiment comprises:

an outlet pipe 30 including a housing 301 and a connector 302 connected to one end of the housing 301; the connector 302 being used to form a connecting segment 33;

a limiting means 60 including a cover 61 and a screwing segment 62 formed on an outer surface of a top end of a body 20; the cover 61 is fitted to an outer surface of a slot 331 before the retaining loop 10 is fixed to the slot 331 of the connecting segment 33 so as to be defined between a rib 131 and the housing 301 of the retaining loop 10, and then the cover 61 is screwed with the screwing segment 62 so that the rib 131 of the retaining loop 10 is defined between the cover 61 and the outer surface of the top end of the body 20, hence the retaining loop 10 is axially limited in a groove 211 of the body 20, and the outlet pipe 30 can not disengage outward from the body 20 and is rotated to control a direction of an outlet end 32 thereof.

It is to be noted that the rib 131 of the retaining loop 10 is located between an internal fence 333 of the slot 331 of the outlet pipe 30 and the top end of the body 20 so as to be limited by the cover 61, accordingly the rib 31 is provided to obtain a limiting purpose.

The flexible deformation generating from the forced retaining loop 10 is served to eliminate a fitting gap between the body 20 and the outlet pipe 30 so as to enhance connecting strength, such that a working precision between related parts is lowered to decrease production cost and increase yield rate of the product.

The retaining loop 10 is fixed on the connecting segment 33 of the outlet pipe 30 in advance and then is connected with the body 20 to avoid conventional welding process and grinding process, thereby preventing from weld craters and enhancing aesthetics appearance.

The limiting means 40, 50, 60 are used to limit the retaining loop 10 in the groove 211 of the body 20 to prevent the outlet pipe 30 from axially moving and rotating relative to the body 20, connecting the faucet securely.

While we have shown and described various embodiments in accordance with the present invention, it is clear to those skilled in the art that further embodiments may be made without departing from the scope of the present invention.

What is claimed is:

1. A faucet connecting structure comprising a body including an internal chamber, and the internal chamber including a groove disposed on a top end thereof, the groove including an orifice formed on a top end thereof;

an outlet pipe including an inlet end and an outlet end; the inlet end including an connecting segment to be inserted into the groove from the orifice of the body, and the connecting segment including a slot secured on an outer surface thereof; wherein the slot is comprised of a peripheral fence, an internal fence, and an external fence;

a retaining loop made of a resilient material and formed in a C-ring shape to define a C-shaped peripheral wall and an elongated opening to be expended and retracted elastically; the peripheral wall including an outer face formed in a wave shape, and the outer face including a plurality of adjacent first raised portions and first recessed portions, and the first raised portions being formed a first flexible deforming structure; the peripheral wall also including an inner face formed in a wave shape, and the inner face including a number of adjacent second raised portions and second recessed portions, the second raised portions being formed a second flexible deforming structure, and the second raised portions being in response to the first recessed portions respectively, the second recessed portions corresponding to the first raised portion individually;

the peripheral wall of the retaining loop including a first end and a second end axially formed thereon, and the first end including a rib radially extending outward therefrom;

the retaining loop being retained in the slot of the connecting segment of the outlet pipe by using the opening, and the rib engaging with the internal fence of the slot, thereafter the retaining loop is further inserted into the groove of the body, such that the retaining loop is pressed by one radial force from the groove and the peripheral fence by ways of the first and the second flexible deforming structures of the outer and the inner faces of the retaining loop to cause one flexible deformation and one radial engaging force against the groove and the slot of the outlet pipe, hence the retaining loop, the body, and the outlet pipe engage with one another tightly, and the outlet pipe is limited securely without vibration with the body when a user touches the outlet pipe;

a limiting means used to limit the retaining loop in the groove of the body to prevent the outlet pipe from disengagement from the body.

2. The faucet connecting structure as claimed in claim 1, wherein the first raised portions, the first recessed portions, the second raised portions, the second recessed portions of the retaining loop axially extend from the first end to the second end.

3. The faucet connecting structure as claimed in claim 2, wherein the limiting means includes a locking hole and a movable engagement block; the locking hole is disposed at a position of the body relative to the groove, and the engaging block is fixed on the outer face of the retaining loop to be retained into the locking hole of the body so that the limiting the retaining loop is axially limited in the groove.

4. The faucet connecting structure as claimed in claim 3, wherein the engagement block extends radially from one of the first raised portions, and the peripheral wall includes a U-shaped cutout formed on two sides of a circumferential direction of the engagement block so that the first raised portion where the engagement is located has a resilient swing function.

5. The faucet connecting structure as claimed in claim 1, wherein the opening of the retaining loop is fixed on a middle section of one of the first raised portions.

6. The faucet connecting structure as claimed in claim 1, wherein the limiting means includes a positioning aperture, a screw bore, and a fixing bolt with screws; the positioning aperture is fixed on the annularly peripheral wall of the retaining loop; the screw bore is disposed on the groove of the body; the fixing bolt is used to screw with the screw bore of the body so that a distal end of the fixing bolt is inserted into the positioning aperture to retain the retaining loop in the groove.

7. The faucet connecting structure as claimed in claim 1, wherein an outlet pipe includes a housing and a connector connected to one end of the housing; the connector is used to form the connecting segment.

8. The faucet connecting structure as claimed in claim 1, wherein the limiting means includes a cover and a screwing segment formed on an outer surface of a top end of a body; the cover is fitted to an outer surface of the slot before the retaining loop is fixed to the slot of the connecting segment so as to be defined between the rib and the housing of the retaining loop, and then the cover is screwed with the screwing segment so that the rib of the retaining loop is defined between the cover and the outer surface of the top end of the body, hence the retaining loop is axially limited in the groove of the body.

9. The faucet connecting structure as claimed in claim 1, wherein the resilient material is selected form a rubber material and a plastic material.

* * * * *